United States Patent [19]

Rogojew

[11] 4,003,352

[45] Jan. 18, 1977

[54] LONGITUDINAL-STROKE INTERNAL COMBUSTION ENGINES

[76] Inventor: Nikolaj Wladimir Rogojew, Schoenburgstr. 42/6, 1040 Vienna, Austria

[22] Filed: Dec. 5, 1974

[21] Appl. No.: 529,828

[30] Foreign Application Priority Data

Dec. 12, 1973 Austria ..... 10160/73

[52] U.S. Cl. ..... 123/58 B

[51] Int. Cl.[2] ..... F02B 57/04

[58] Field of Search ..... 123/58 B, 75 R, 58 BB, 123/58 BA, 58 R, 196 R; 92/71

[56] References Cited

UNITED STATES PATENTS

| | | | |
|---|---|---|---|
| 1,300,098 | 4/1919 | Almen | 123/58 BB |
| 1,326,689 | 12/1919 | Reagan | 123/58 B |
| 1,637,017 | 7/1927 | Almen | 123/58 BB |
| 1,714,145 | 5/1929 | Sperry | 92/71 X |
| 2,241,046 | 5/1941 | Wahlmark | 92/71 X |
| 3,257,855 | 6/1966 | Dangauthier | 123/58 R |
| 3,654,906 | 4/1972 | Airas | 123/58 B X |
| 3,943,895 | 3/1976 | Howell | 123/196 R X |

*Primary Examiner*—Charles J. Myhre
*Assistant Examiner*—W. Anderson

[57] ABSTRACT

An improved crankshaft-driven internal combustion engine of the type having pistons reciprocable along an axis parallel to the crankshaft axis is described. Communication is effected, between the suction and exhaust ports of the engine and successive ones of the cylinders in which the pistons are mounted, by means of an apertured member supported for rotation on a crank having an axis parallel to and displaced from the crankshaft axis. The apertured member has opposed planar faces in engagement with the respective suction and exhaust ports and with the cylinders. A planetary gearing arrangement is associated with such apertured member and with the housing of the engine for orbiting the apertured member about the crankshaft axis as it rotates about its own axis. Compensating weights are suitably disposed on portions of the piston operating assembly, which assembly includes a wobble member mounted on a crank forming an acute angle to the crankshaft axis, and a connecting rod and ball joint assembly interconnecting the wobble member to each piston.

18 Claims, 8 Drawing Figures

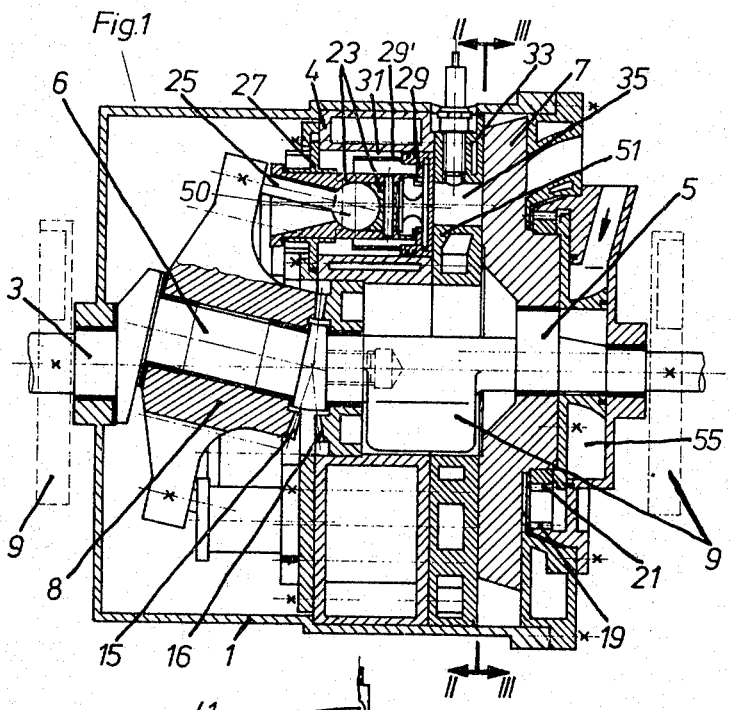
Fig.1
6
25
27
4
23
29'
31
29
II
III
33
7
35
51
50
5
3
55
9
8
15
16
1
21
19
9
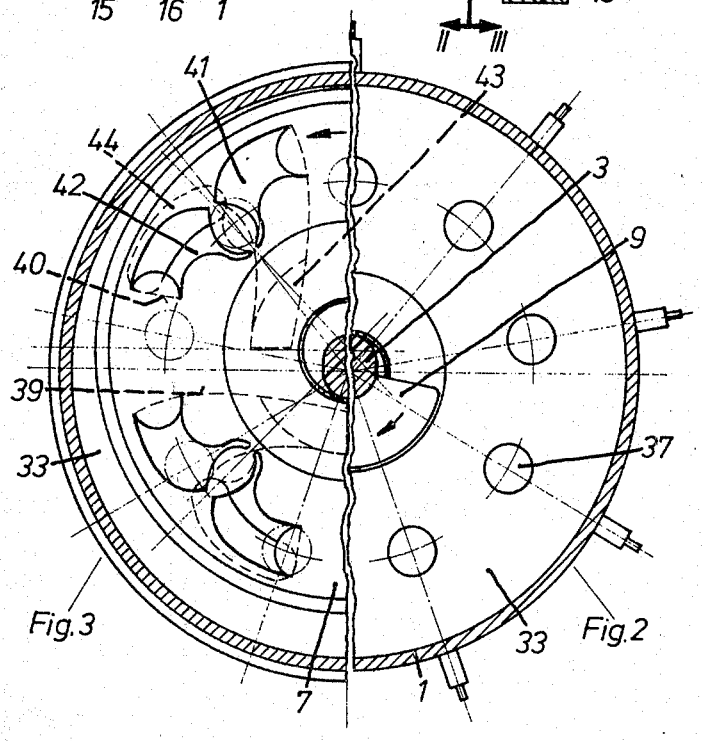
II
III
41
43
44
42
3
9
40
39
33
37
Fig.3
7
1
33
Fig.2

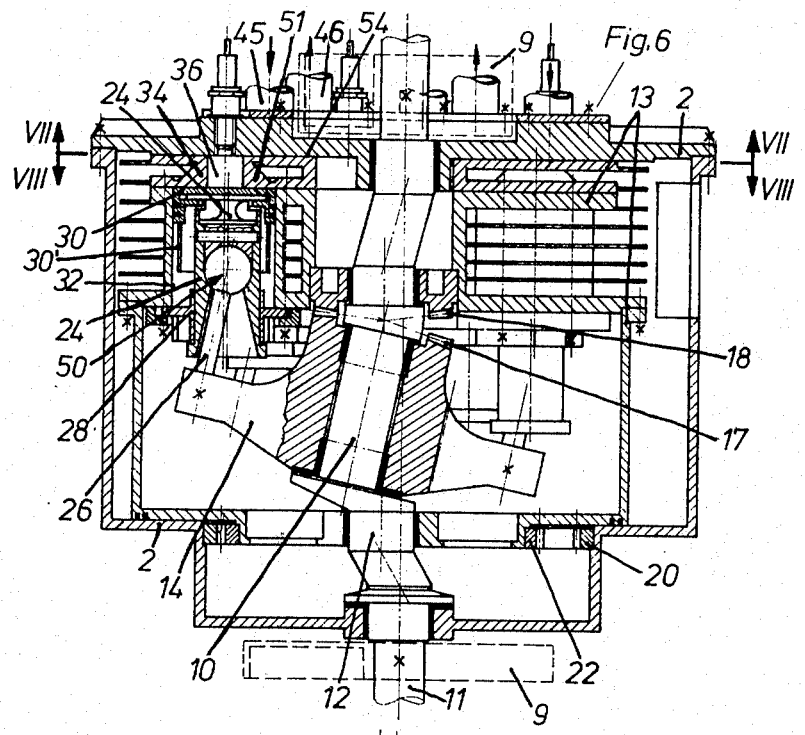
Fig.6
45
51
46
54
9
36
24
34
13
2
VII
VIII
30
30'
32
24
50
28
26
2
14
10
12
11
9
22
20
18
17
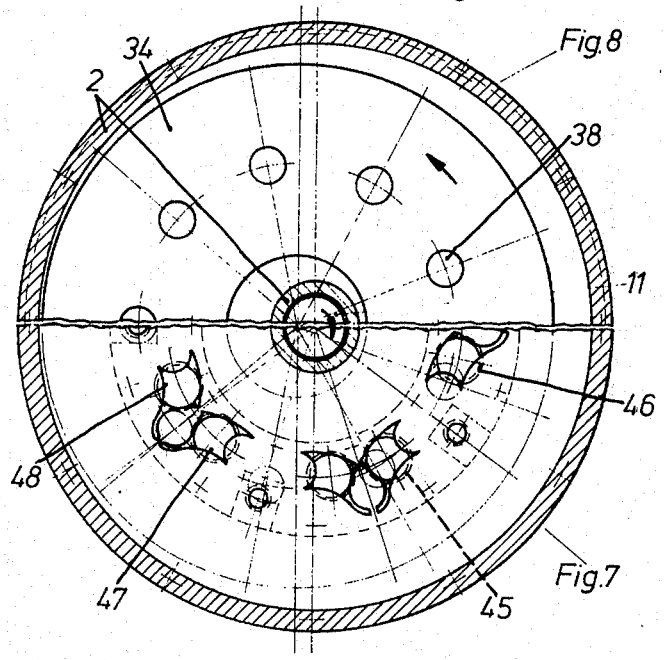
Fig.8
34
2
38
11
46
48
47
45
Fig.7

LONGITUDINAL-STROKE INTERNAL COMBUSTION ENGINES

BACKGROUND OF THE INVENTION

The invention concerns a longitudinal-stroke internal combustion engine of the type having a fixed housing and a plurality of pistons reciprocally movable in cylinders parallel to the axis of a crankshaft that is rotatably mounted in the housing. A wobble-type piston actuation member is rotatably supported on the crankshaft, such member being connected to the pistons by means of individual connecting rods and ball joints. Facilities carried by the crankshaft are provided for successively effecting communication between the suction and exhaust ports of the engine and successive ones of the cylinders via a cylinder head having a plurality of gas exchange channels in fixed communication with the respective cylinders.

In known machines of this type typified by the arrangement described in U.S. Pat. No. 1,282,179, such last-mentioned facilities include a cam arrangement which, by means of cyclic impulses, effects the opening and closing of the gas exchange channels by means of valves supported for oscillation in the housing.

Such typical arrangements manifest excessive play, wear and tear and vibration in the relatively moving parts, whereby the relation of such parts continually change and as a result the subassemblies necessary for the control of the valve and cam assemblies require regular supervision and frequent maintenance. Additionally, the construction of this type of machine is bulky, complex and expensive; further, no satisfactory provisions have been available for the dynamic balancing of the machine to permit high rotational speeds of the crankshaft.

SUMMARY OF THE INVENTION

These disadvantages are avoided in accordance with the invention with an improved longitudinal-stroke internal combustion engine of the above-mentioned type. In an illustrative embodiment, the facilities for successively effecting communication between the cylinders and the suction and exhaust ports of the engine include an apertured member having a planar face in engagement with a planar face of the cylinder head, and at least one additional face in engagement with the suction and exhaust ports. Such apertured member has a plurality of suction and exhaust channels extending therethrough between its planar faces. Either the cylinder head in which the gas exchange channels are disposed or the apertured member itself is supported about the crankshaft axis, while the other one of such subassemblies is supported for rotation on a first crank of the crankshaft having an axis parallel to and displaced from the crankshaft axis. Suitable planetary gearing is cooperatively disposed on the housing and on the other one of such subassemblies for orbiting said other subassembly about the crankshaft axis as it rotates about its own axis.

Additionally, a compensating ring may be secured to the socket member to each ball joint to form a first assembly, in which case such first assembly is coupled to the associated piston for movement of the socket member normal to the piston axis. Preferably, the compensating ring has a mass equal to that of the associated piston, and is supported for axial movement along the associated socket member.

BRIEF DESCRIPTION OF THE DRAWING

The invention is further set forth in the following detailed description taken in conjunction with the appended drawing, in which:

FIG. 1 is a vertical section through a first embodiment of a longitudinal-stroke internal combustion engine constructed in accordance with the invention;

FIG. 2 is a sectional view taken along line 2—2 of FIG. 1;

FIG. 3 is a sectional view taken along line 3—3 of FIG. 1;

FIG. 6 is a vertical section through a second embodiment of a longitudinal-stroke internal combustion engine constructed in accordance with the invention;

FIG. 7 is a sectional view taken along line 7—7 of FIG. 6; and

FIG. 8 is a sectional view taken along line 8—8 of FIG. 6.

DETAILED DESCRIPTION

Figure 4:
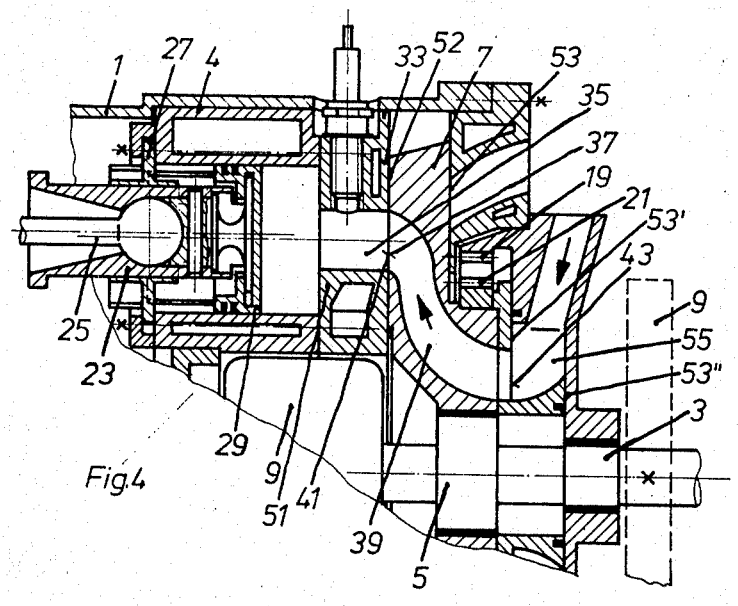
FIGS. 4 and 5 are enlarged vertical sections similar to FIG. 1, but respectively illustrating details of the suction and exhaust channels of the arrangement of FIG. 1 in greater detail.
Figure 5:
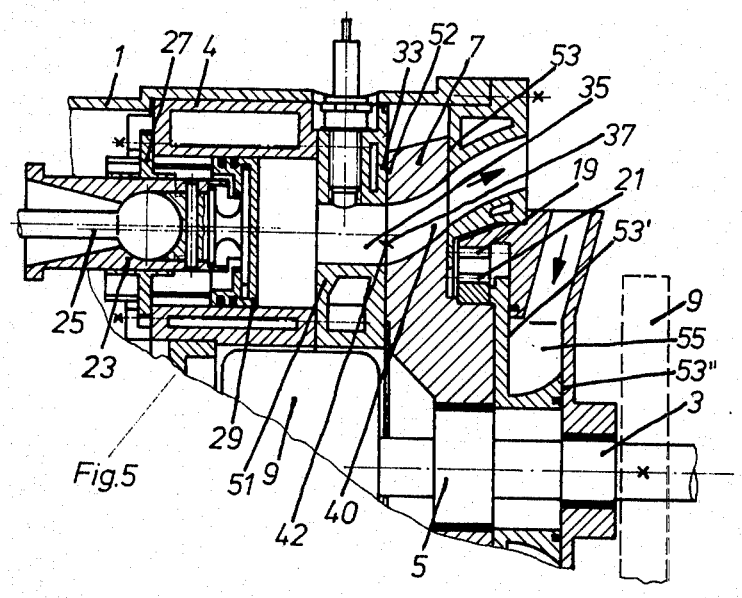

Referring to the drawing, the first embodiment illustrated in FIGS. 1 – 5 concerns a nine-cylinder longitudinal-stroke internal combustion engine having a cylinder block 4 secured against rotation in an engine housing 1. A crankshaft 3 is supported for rotation about a first axis in the housing 1, and carries compensating weights 9—9 to aid in the dynamic balancing of the machine. The crankshaft is provided with a plurality of cranks including two spaced cranks 5 and 6, which illustratively project from the same side of the crankshaft axis in coplanar fashion. The crank 5 has its axis parallel to the crankshaft axis, while the crank 6 is so disposed that its axis forms an acute angle with the crankshaft axis.

An apertured member 7 is rotatably supported on the crank 5 and serves for the control of the opening and closing of gas exchange channels 35—35 disposed in a cylinder head 33 and fixedly communicating with the cylinders in the block 14. The member 7 includes a plurality of suction channels 39 and exhaust channels 40 extending therethrough.

A conventional wobble member 8 is rotatably supported on the crank 6, and is coupled to the block 4 over a conical gear assembly 15, 16 having an even number of teeth. The gear 16 is secured coaxially with the block 4, while the gear 15 is secured coaxially with the wobble member 8.

A gear 19 affixed to the housing 1 is disposed in meshing engagement with a gear 21, which is coaxially secured on the member 7 and thereby on the crank 5, whereby the gear 21 acts as a planetary gear relative to the gear 19. In this way, rotation of the crank 5 about its axis, which is displaced from the crankshaft axis as noted above, results in an orbital movement of the member 7 about the cranskshaft axis.

The wobble member 8 is joined to connecting rods 25—25 individually associated with the pistons of each of the nine cylinders. The axis of each rod 25 is parallel to the axis of the crank 6. The rods 25 terminate in ball-shaped heads at the ends thereof remote from the wobble member 8, such heads forming the ball members of ball joints 50—50.

Each ball joint 50 has a socket member 23, which is connected to the associated piston 29 and whose center of gravity coincides with the midpoint of the associated ball member. The socket member is so coupled to the associated piston that their respective axes are always aligned parallel to each other, whereby during the common movement of the piston and the socket member, such elements are shifted toward and away from each other in a direction perpendicular to the piston axis.

In order to further dynamically balance the engine a compensating ring 27 is disposed on each socket member 23. Each such ring, which illustratively exhibits the same mass as the associated piston 29 is mounted for axial movement along the socket member 23 to vary the plane of the weight compensation. In particular, the center of gravity of each compensating ring 27 is arranged to coincide with the center of the ball member of the ball joint 50 at the midpoint of the stroke of the piston 29.

The respective cylinders in the block 4 are distributed in spaced relation around the central axis of the block in such a way that their individual axes lie on a circle and are disposed parallel to the axis of the block. The block and the associated cylinder head 33 are supported for limited movement along the block axis, and in particular are urged toward the apertured member 7 so that the head 33 is always pressed against the member 7. Consequently, if wear and tear on such mating surfaces occur at all, it merely serves to improve the tightness of engagement between the head 33 and the member 7. In this way, the gas exchange channels 35 arranged in the cylinder head 33 are constantly urged into fixed communication with successive ones of the suction and exhaust channels 39 and 40 as the crankshaft rotates.

The gas exchange channels 35 are disposed with their axes in a circle which is concentric to the axis of the block 4 and thereby to that of the housing 1. Each channel 35 terminates in an opening 37 on a planar front face of the cylinder head 33 that bears against the member 7. Such openings 37, which are smaller than the diameter of the associated pistons, are disposed at equal intervals from each other and at equal radial distances from the central axis of the head 33.

The member 7 illustratively has the form of a ring-shaped disc symmetrically disposed for rotation about the axis of the crank 5. The member 7 has, on one side, a planar face 52 in engagement with the front face of the block 33 exhibiting the openings 37 and, on the other side, a plurality of opposed planar faces 53, 53', 5'' defining different planes for facilitating communication with the fixed suction and exhaust ports of the engine.

The illustrated four suction channels 39 and four exhaust channels 40 in the member 7 respectively terminate in sickle-shaped openings 41 and 42 on the face 52 of the member 7 that is in engagement with the cylinder head 33. The openings 41, 42 successively communicate with the openings 37 of the gas exchange channels 35, which have a circular cross section. On the other side of the member 7, its respective suction and exhaust channels terminate in sickle-shaped openings 43 and 44. In the suction position of the engine shown in FIG. 4, the openings 53 associated with the suction stroke communicate with a chamber 55 defining the suction port of the engine. Similarly, in the position shown in FIG. 5, the openings 44 associated with the exhaust stroke communicate with a corresponding chamber forming the exhaust port of the engine.

In the scheme of FIGS. 1 – 5, the central axes of the individual gas exchange channels 35 are disposed approximately on the pitch circle of the gear 19. This has been found to improve the seal between the cylinder head 33 and the member 7 as a consequence of the reaction force resulting from the explosion of the combustible mixture taking place in the cylinders in a conventional manner during operation of the engine. Such reaction force is in a direction to urge the block 4 together with the head 33 to the right as shown in FIG. 1 against the face 52 of the member 7.

In the arrangement of FIGS. 1 – 5, the number of suction channels 39 and exhaust channels 40 in the member 7 are each equal to N−1/2, where N is the number of cylinders. Also the number of teeth on the gear 21 is illustratively equal to the number of teeth on the gear 19, reduced by the quotient of the number of teeth on the gear 19 and the number of cylinders in the block.

In a second embodiment of the invention shown in FIGS. 6 – 8, a crankshaft 11 supported in housing 2 has two adjacent cranks 11 and 12. In this case the crank 10, which has its axis at an acute angle to the crankshaft axis, extends outwardly from a second crank 12 which has an axis parallel to the crankshaft axis. The cranks 10 and 12 may lay in the same plane.

A cylinder block 14 and an associated cylinder head 33 are rotatably supported on the crank 12. A wobble member 14 is supported on the crank 10. A conical gear pair 17 and 18 having an even number of teeth, are provided between the wobble member 14 and the cylinder block 13 to permit relative movement therebetween.

The engine of FIGS. 6 – 8 is so arranged that the suction and exhaust channels that interface with the gas exchange channels in the cylinder head are distributed symmetrically about the crankshaft axis in a fixed end wall of the housing 2, while the cylinder block and head orbit around such crankshaft axis, rather than vice versa as in FIGS. 1 – 5. To permit such orbiting of the cylinder block 13, the latter is connected to a gear 22 coaxially secured thereto, such gear 22 meshing in planetary-gear fashion with a gear 20 affixed to the housing 2.

In this case, the number of teeth on the gear 20 is equal to the number of teeth on the gear 22 increased bythe quotient of the number of teeth on the gear 22 and the number of cylinders.

A plurality of connecting rods 26 — 26 are coupled to the wobble member 14, such rod 26 having their ends respectively terminating in the ball members of ball joints 50 as in the first embodiment. A compensating ring 28 is disposed as indicated around each socket member 24 of the associated ball joint 50.

The locations of the centers of gravity and the relationships of the masses of the parts in FIGS. 6 – 8 are chosen analogously to those of the embodiment of FIGS. 1 – 5. However, while in the case of FIGS. 1 – 5 the axis of each cylinder is located approximately on the pitch circle of the teeth of the fixed gear 19, in the case of FIGS. 6 – 8 the axis of each cylinder is disposed approximately on the pitch circle of the teeth of the orbiting gear 22.

The cylinder head 32 has a plurality of gas exchange channels 36, one for each cylinder. The channels 36 terminate in openings 38 on the face of the cylinder head in engagement with the mating apertured end of the housing 2. The openings 38 are spaced from each other by equal angular distances, and such openings are disposed at equal radial distances from the central axis of the head 32. As before, such openings have a diameter which is smaller than the diameter of the associated pistons.

Preferably, the number of suction and exhaust channels associated with the apertured housing portion are each equal to N+1/2, where N is the number of cylinders. The suction and exhaust channels terminate, at the face of the apertured housing portion mating with the gas exchange channels 36, in sickle-shaped windows 47 and 48. The windows 47, 48 are symmetrically distributed around the central axis of the housing 2 as shown in FIG. 7.

In all other respects, the construction, function and dynamic balancing of the arrangement of FIGS. 6 – 8 are similar to that previously described in connection with FIGS. 1 – 5.

In the foregoing, the invention has been described in connection with illustrative arrangements thereof. Many variations and modifications will now occur to those skilled in the art. It is accordingly desired that the scope of the appended claims not be limited to the specific disclosure herein-contained.

What is claimed is:

1. In an internal combustion engine having a housing with which externally accessible suction and exhaust ports are associated, a crankshaft supported in the housing for rotation about a first axis, a cylinder block having an odd number of cylinders distributed around the first axis, the cylinders respectively containing pistons reciprocable along a second axis parallel to the first axis, means connected to the crankshaft for operating the pistons, means carried by the crankshaft for successively effecting communication between the suction and exhaust ports and successive ones of the cylinders, the communication effecting means comprising, in combination, a first apertured member having a plurality of gas exchange channels therethrough corresponding to and in fixed communication with the respective cylinders in the cylinder block, each gas exchange channel terminating at a planar first face of the first apertured member remote from the cylinder block, a second apertured member having a planar second face parallel to and engageable with the first face of the first apertured member, the second apertured member having a plurality of suction and exhaust channels for providing communication between the second face and the suction and exhaust ports, means for supporting one of the first and second apertured members about the first axis, means supporting the other one of the first and second apertured members for rotation about a third axis parallel to the first axis, and gear means cooperatively disposed on the housing and on said other apertured member for orbiting said other apertured member about the first axis as it rotates about the third axis, the improvement in which both the suction and exhaust ports terminate in at least one plane parallel to and spaced from the second face, and in which the second apertured member comprises at least one third planar face parallel to and engageable with the terminating plane of the suction and exhaust ports, each third face being parallel to and axially spaced from the second face, the suction and exhaust channels extending through the second apertured member between the respective second and third faces thereof.

2. An engine as defined in claim 1, in which the gear means comprises, in combination, a first gear coaxially secured to said other apertured member, and a second gear secured to the housing and meshing with the first gear in planetary relation.

3. An engine as defined in claim 2, in which the crankshaft has a first crank whose axis coincides with the third axis, in which said first apertured member is mounted for rotation about the first axis, and in which said second apertured member is secured to the first crank for rotation about the third axis.

4. An engine as defined in claim 3, in which the number of teeth on the second gear is equal to the number of teeth on the first gear reduced by the quotient of the number of teeth on the first gear and the number of cylinders in the cylinder block.

5. An engine as defined in claim 3, in which the number of suction and exhaust channels in the second apertured member is equal to N−1/2, wherein N is the number of cylinders in the cylinder block; and in which the suction and exhaust channels in the second apertured member terminate on the planar second face thereof in sickle-shaped openings.

6. An engine as defined in claim 3, in which the second axis coincides with the pitch circle of the teeth of the first gear.

7. An engine as defined in claim 2, in which the crankshaft has a first crank whose axis coincides with the third axis, in which said second apertured member is fixedly disposed around the first axis, and in which said first apertured member is secured to the first crank for rotation about the third axis.

8. An engine as defined in claim 7, in which the number of teeth of the second gear is equal to the number of teeth of the first gear increased by the quotient of the number of teeth of the first gear and the number of cylinders.

9. An engine as defined in claim 7, in which the number of suction and exhaust channels in the second apertured member is equal to N+1/2, where N is the number of cylinders in the cylinder block; and wherein suction and exhaust channels in the second apertured member terminate on the planar second face thereof in sickle-shaped openings.

10. An engine as defined in claim 7, in which the second axis coincides with the pitch circle of the teeth on the second gear.

11. An engine as defined in claim 1, in which the cylinder block is mounted for displacement along the second axis.

12. An engine as defined in claim 1, in which the crankshaft comprises a first crank having an axis coincident with the third axis and a second crank having a fourth axis defining an acute angle with the first axis; and in which the piston operating means comprises, in combination, a wobble member rotatably supported on the second crank, a ball joint connected to the piston, and means including a connecting rod for coupling the wobble member to the ball joint.

13. An engine as defined in claim 12, in which the second crank is disposed adjacent to and extends outwardly from the first crank.

14. An engine as defined in claim 12, in which the ball joint comprises, in combination, a socket member and an independent ball member terminating an end of the connecting rod, the center of gravity of the socket member coinciding with the center of the ball member.

15. An engine as defined in claim 12, in which the axis of the connecting rod is parallel to the fourth axis.

16. An engine as defined in claim 14, further comprising a compensating ring secured to the socket member to form a first assembly, and means coupling the first assembly to the associated piston for movement of the socket member normal to the second axis.

17. An engine as defined in claim 15, in which the mass of the compensating ring is equal to that of the associated piston.

18. An engine as defined in claim 16, further comprising means for supporting the compensating ring for axial movement along the socket member.

* * * * *